US008677778B2

(12) United States Patent
Jeon et al.

(10) Patent No.: US 8,677,778 B2
(45) Date of Patent: Mar. 25, 2014

(54) REFRIGERATOR

(75) Inventors: Sang Woon Jeon, Namyangju-si (KR); Sei Ill Jeon, Gimpo-si (KR); Yun Ho Yang, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 174 days.

(21) Appl. No.: 13/137,305

(22) Filed: Aug. 4, 2011

(65) Prior Publication Data

US 2012/0042671 A1 Feb. 23, 2012

(30) Foreign Application Priority Data

Aug. 19, 2010 (KR) ..... 10-2010-0080066

(51) Int. Cl.
*F25D 3/00* (2006.01)

(52) U.S. Cl.
USPC ..... 62/389; 62/449

(58) Field of Classification Search
USPC ..... 62/389, 132, 449, 344, 441; 312/401, 312/404
See application file for complete search history.

(56) References Cited

U.S. PATENT DOCUMENTS 4,632,280 A * 12/1986 Mawby et al. ..... 222/275
5,211,462 A * 5/1993 Bien et al. ..... 312/404
6,019,447 A * 2/2000 Jackovin ..... 312/405
6,648,187 B1 * 11/2003 Shypkowski ..... 222/527
6,810,682 B1 * 11/2004 Schuchart et al. ..... 62/98
7,007,500 B2 * 3/2006 Lee ..... 62/389
7,201,005 B2 * 4/2007 Voglewede et al. ..... 62/126
7,430,873 B2 * 10/2008 Kim et al. ..... 62/71
7,490,916 B2 * 2/2009 Anderson et al. ..... 312/407
7,597,124 B2 * 10/2009 Litto ..... 141/285
7,793,690 B2 * 9/2010 Voglewede et al. ..... 141/362
2008/0168782 A1 7/2008 Kavchale et al.
2010/0155415 A1 6/2010 Ashrafzadeh et al.
2010/0175783 A1 7/2010 Kim

FOREIGN PATENT DOCUMENTS

EP 1 605 219 12/2005
JP 4-13072 1/1992
JP 2003-240420 8/2003
KR 10-2004-0009142 1/2004
WO 2007/077166 7/2007
WO 2008/096982 8/2008

OTHER PUBLICATIONS

European Search Report for corresponding European Application 11174295.3-1605; dated Aug. 20, 2013.

* cited by examiner

*Primary Examiner* — Mohammad M Ali
(74) *Attorney, Agent, or Firm* — Staas & Halsey LLP

(57) ABSTRACT

A refrigerator in which a right door that a user more frequently opens has a width less than that of a left door and a dispenser and a display unit are mounted at the center of a front surface of the refrigerator, resulting in enhanced usability. In the refrigerator, furthermore, a door handle is hidden and a drawer type storage container is installed below the dispenser and the display unit to enhance usability of the refrigerator.

18 Claims, 9 Drawing Sheets

REFRIGERATOR

CROSS-REFERENCE TO RELATED APPLICATIONS

This application claims the benefit of Korean Patent Application No. 2010-0080066, filed on Aug. 19, 2010 in the Korean Intellectual Property Office, the disclosure of which is incorporated herein by reference.

BACKGROUND

1. Field

Embodiments relate to a refrigerator, doors of which, hinged to opposite lateral sides 1of a main body to open or close a storage compartment, have an improved design and configuration, thereby achieving a more pleasant outward appearance and enhanced usability of the refrigerator.

2. Description of the Related Art

In the case of French door type refrigerators, the interior of the refrigerator is divided into upper and lower storage compartments, the upper storage compartment serving as a refrigerating compartment and the lower storage compartment serving as a freezing compartment.

The refrigerating compartment is provided with a pair of pivoting opening/closing doors, which are hinged to opposite lateral sides of a refrigerator main body to open or close the refrigerating compartment. The freezing compartment is provided with a drawer type sliding door, which slides into or out of the main body.

The pair of pivoting opening/closing doors is provided at an inner surface thereof with door rack(s) for storage of beverages or relatively small items of food.

The pair of pivoting opening/closing doors has approximately the same width and is provided at adjacent edges thereof with handles.

One of the pair of pivoting opening/closing doors is provided with a dispenser to allow a user to dispense water or ice without opening the door and a display unit to display operating modes of the refrigerator, the display unit containing an input unit as occasion demands.

In the above-described conventional French door type refrigerator, the dispenser and the display unit are installed at laterally deviated positions of a front surface of the refrigerator.

SUMMARY

Therefore, it is one aspect to provide a refrigerator in which a right door of a pair of pivoting opening/closing doors that a user more frequently opens has a width less than that of a left door, thereby minimizing leakage of cold air and enhancing usability of the refrigerator.

It is another aspect to provide a refrigerator in which a dispenser and a display unit are located at the center of a front surface of the refrigerator, thereby providing the refrigerator with a more pleasant outward appearance and enhanced usability.

It is a further aspect to provide a refrigerator in which a door handle is not exposed to the outside, thereby providing the refrigerator with a tidy outward appearance.

Additional aspects will be set forth in part in the description which follows and, in part, will be apparent from the description, or may be learned by practice of the invention.

In accordance with one aspect, a refrigerator includes a main body, a storage compartment defined in the main body and left and right doors hinged to opposite lateral sides of the main body to open or close the storage compartment, wherein the left door has a width greater than that of the right door, and wherein the left door includes a dispenser located at the center of opposite lateral surfaces of the main body.

The dispenser may include a dispensing space recessed in a front surface of the left door, and the dispensing space may include a left door grip portion recessed in a left wall surface of the dispensing space to enable opening or closing of the left door.

The dispenser may include a dispensing space recessed in a front surface of the left door, and the right door may include a right door grip portion recessed in a left surface of the right door to enable opening or closing of the right door through the dispensing space.

The left door may further include a display unit serving to display operating modes of the refrigerator or having an input unit, and the display unit may be located above the dispenser at the center of opposite lateral surfaces of the main body.

The left door may further include a drawer type storage container mounted in a sildable manner, and the drawer type storage container may be located below the dispenser at the center of opposite lateral surfaces of the main body.

The dispenser may include a dispensing space recessed in a front surface of the left door to have a predetermined depth and a water tray provided on the bottom of the dispensing space, and the water tray may be adapted to slide out of the dispensing space.

The dispenser may include an outlet to dispense water to the outside, and the outlet may be configured to be inserted into an entrance of a bottle-shaped container having a standard size to allow the container to be secured to the outlet.

The refrigerator may further include a securing device to secure a bottle-shaped container having a standard size, thereby allowing water discharged from the dispenser to be introduced into an entrance of the bottle-shaped container.

The refrigerator may further include a control unit to dispense water from the outlet when the bottle-shaped container is secured to the outlet and stop dispensing the water when the quantity of water stored in the bottle-shaped container reaches a preset quantity.

In accordance with another aspect, a refrigerator includes a main body, a storage compartment defined in the main body and left and right doors hinged to opposite lateral sides of the main body so as to open or close the storage compartment, wherein the left door includes a center section located at the center of opposite lateral surfaces of the main body, and wherein the center section includes a dispenser having a dispensing space recessed in a front surface of the left door and a display unit serving to display operating modes of the refrigerator or having an input unit.

The center section may further include a drawer type storage container.

The dispensing space may be provided at opposite lateral sides thereof with left and right door grip portions to allow the left and right doors to be gripped for opening or closing of the doors.

The drawer type storage container may be mounted to the left door in a slidable manner.

The dispenser may include a water tray to support a container, and the water tray may be adapted to slide out of the dispensing space.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
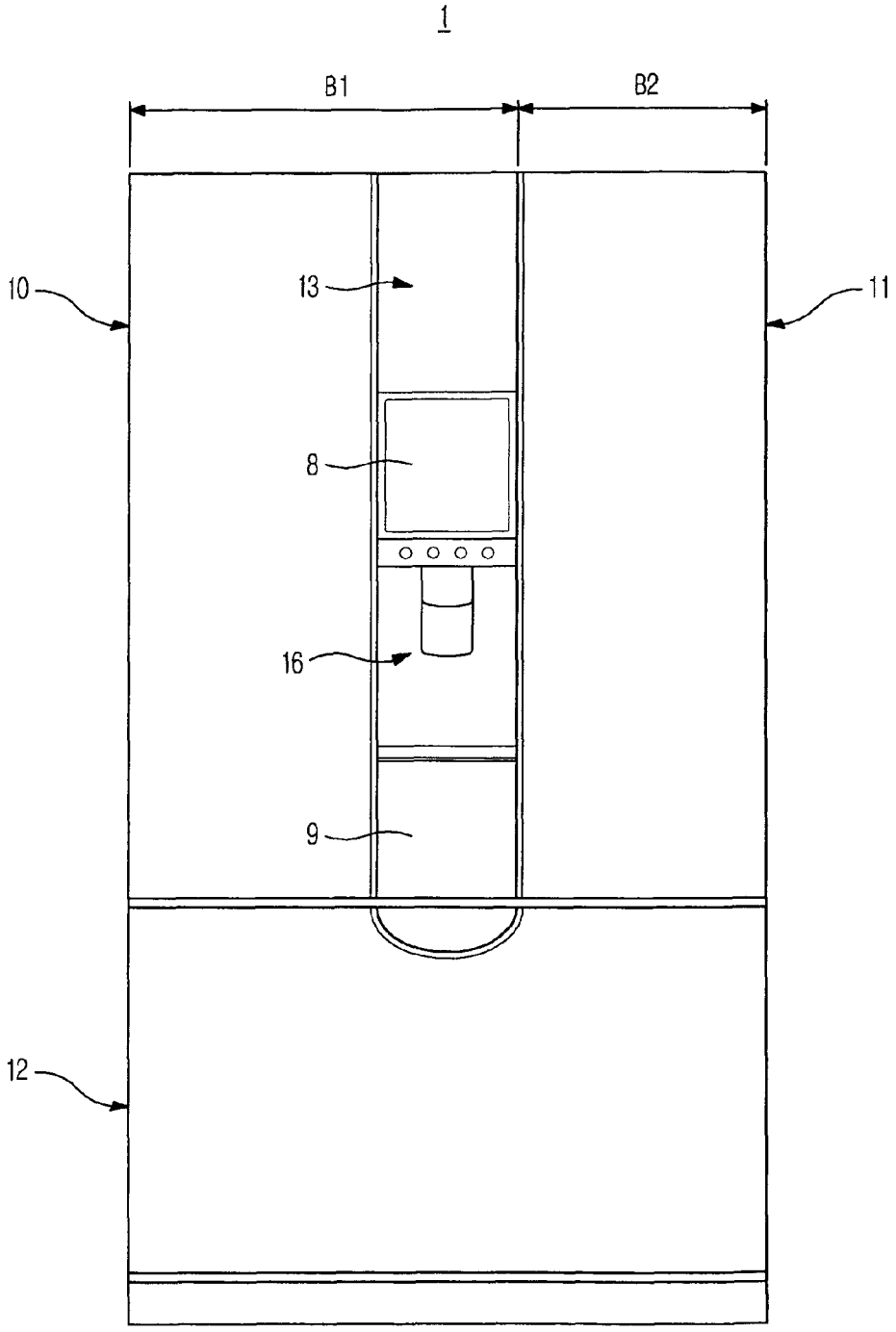
FIG. 1 is a front view illustrating a refrigerator according to an embodiment.

Reference will now be made in detail to the embodiments, examples of which are illustrated in the accompanying drawings, wherein like reference numerals refer to like elements throughout.

Figure 2:
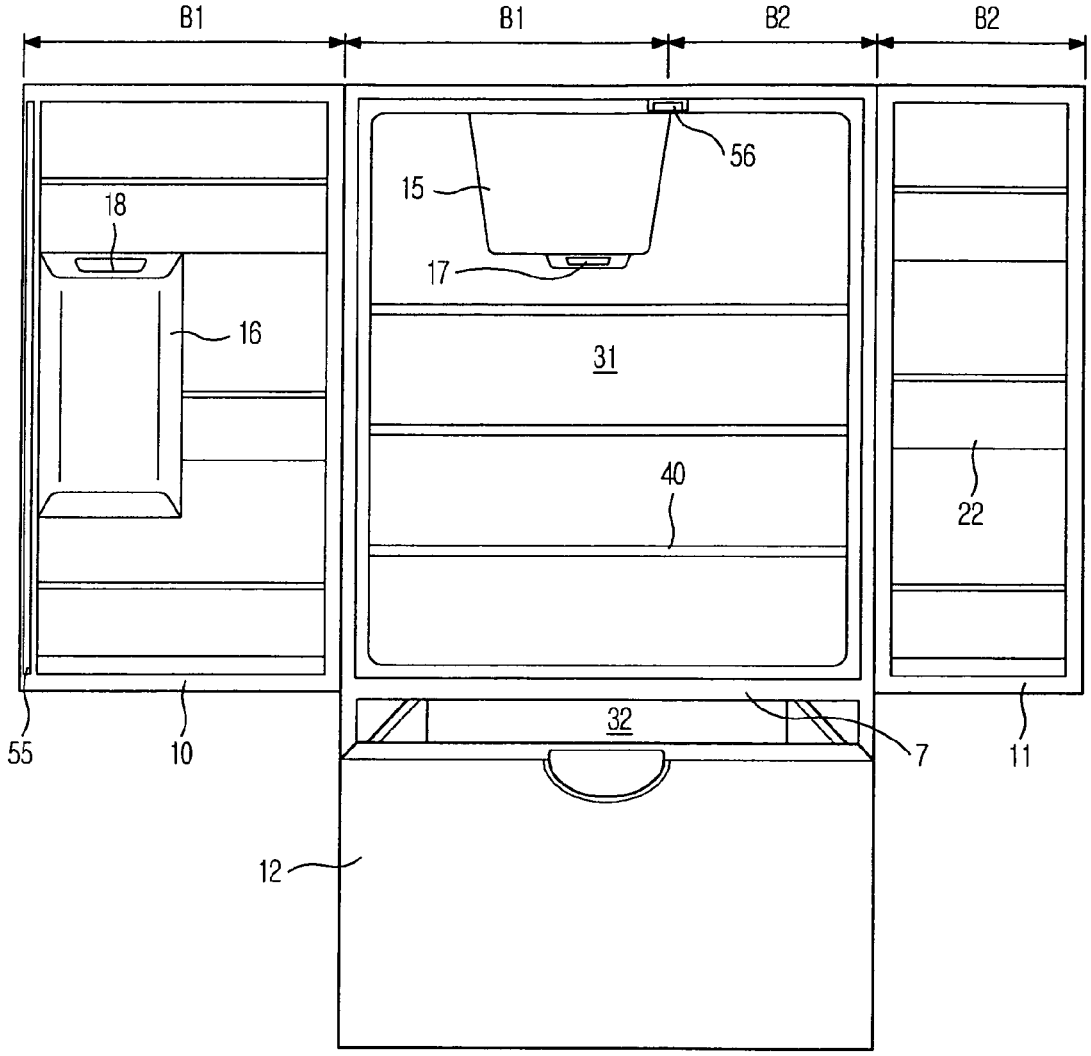
FIG. 2 is a front view illustrating a state in which doors of the refrigerator according to the embodiment are open.

FIG. 1 is a front view illustrating a refrigerator according to an embodiment, and FIG. 2 is a front view illustrating a state in which doors of the refrigerator according to the embodiment are open.

Referring to FIGS. 1 and 2, the refrigerator according to the embodiment is of a French door type and includes a box-shaped main body 1 in which storage compartments 31 and 32 are defined. The storage compartments 31 and 32 are divided, by a horizontal partition 7, into an upper refrigerating compartment 31 and a lower freezing compartment 32.

The refrigerating compartment 31 has an open front side and left and right pivoting opening/closing doors 10 and 11 are coupled to opposite lateral sides of the main body 1 by hinge members so as to open or close the refrigerating compartment 31.

The doors 10 and 11 are provided at inner surfaces thereof with door racks 22 for storage of small items of food.

The left door 10 is further provided at the inner surface thereof with a filler 55. The filler 55 has an elongated bar shape and serves to form a seal between the left and right doors 10 and 11 when the left and right doors 10 and 11 are closed.

The refrigerating compartment 31 is provided with a filler recess 56. When the left door 10 is closed, a protrusion (not shown) formed at the filler 55 is inserted into the filler recess 56 to allow the filler 55 to pivot to a sealing position.

The freezing compartment 32 is provided with a drawer type sliding door 12, which slides into or out of the freezing compartment 32.

An ice-making chamber 15 is provided in an upper lateral region of the refrigerating compartment 31.

Although not illustrated, an icemaker to make ice and an ice storage container to store ice made by the icemaker are received in the ice-making chamber 15.

The ice storage container is configured to receive ice dropped from the icemaker and has an ice discharge hole 17 formed at the bottom thereof. The left door 10 is provided with a dispenser 16. The dispenser 16 includes a discharge chute 18 to guide the ice discharged through the ice discharge hole 17 of the ice-making chamber 15 to the outside of the left door 10.

The discharge chute 18 has an entrance, a position of which coincides with that of the ice discharge hole 17 in a closed state of the left door 10.

The refrigerating compartment 31 contains a shelf 40 to support food placed thereon. The shelf 40 also serves to vertically divide the interior storage space of the refrigerating compartment 31.

Of the left and right doors 10 and 11 to open or close the refrigerating compartment 31, a width B1 of the left door 10 is greater than a width B2 of the right door 11.

Since most people are right handed, the right door 11 is likely to be more frequently opened to stow or retrieve small items of food.

Accordingly, providing the right door 11 with the width B2 that is less than the width B1 of the left door 10 may allow the user to more easily stow or retrieve food.

This may also reduce leakage of cold air from the refrigerating compartment 31 upon opening/closing of the door 11 and thus, the refrigerator is more economical owing to energy saving effects.

In the present embodiment, the left door 10 includes a center section 13 extending leftward from a right end thereof by a predetermined width.

The center section 13 is located at the center of a front surface of the main body 1 between opposite lateral surfaces of the main body 1.

The center section 13 is provided with the dispenser 16 to allow the user to dispense water or ice without opening the doors 10 and 11. In addition, a display unit 8 and a drawer type storage container 9 are provided at the center section 13. Here, the display unit 8 serves to display operating modes of the refrigerator or to allow the user to control operation of the refrigerator.

Figure 6:
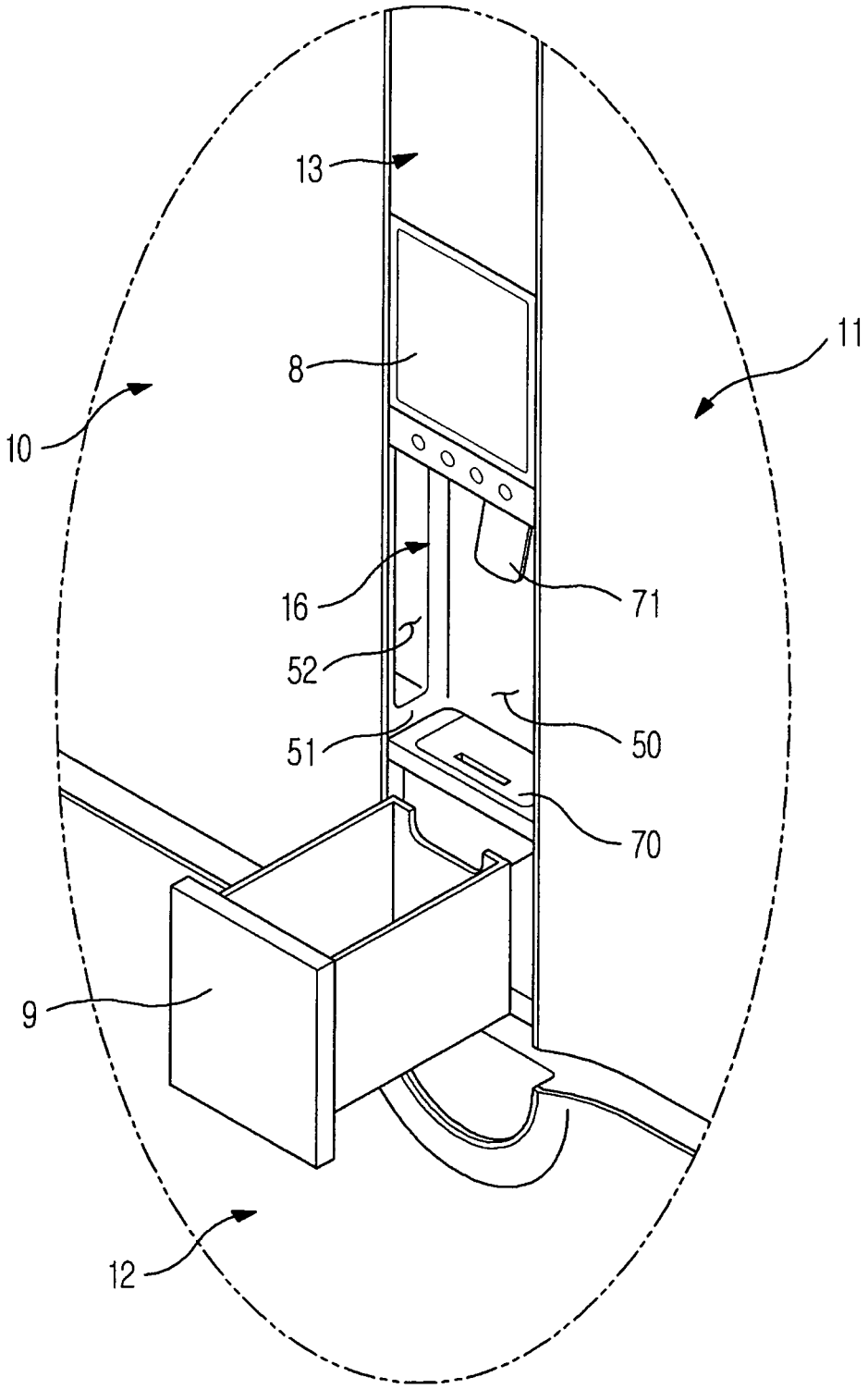
FIG. 6 is a perspective view illustrating a state in which a drawer type storage container of the refrigerator according to the embodiment slides out of a dispensing space.

The drawer type storage container 9 is mounted to the center section 13 in a slidable manner (see FIG. 6).

The display unit 8 may be located above the dispenser 16 so as to be at eye level with the user, thereby allowing the user to easily view a display screen or control operation of the refrigerator. The drawer type storage container 9 may be located below the dispenser 16 to assure easy access by children.

With the above-described arrangement, as a result of positioning the dispenser 16, the display unit 8 and the drawer type storage container 9 at the center of opposite lateral surfaces of the main body 1, the user may more easily and stably use the refrigerator without opening the doors 10 and 11.

Figure 3:
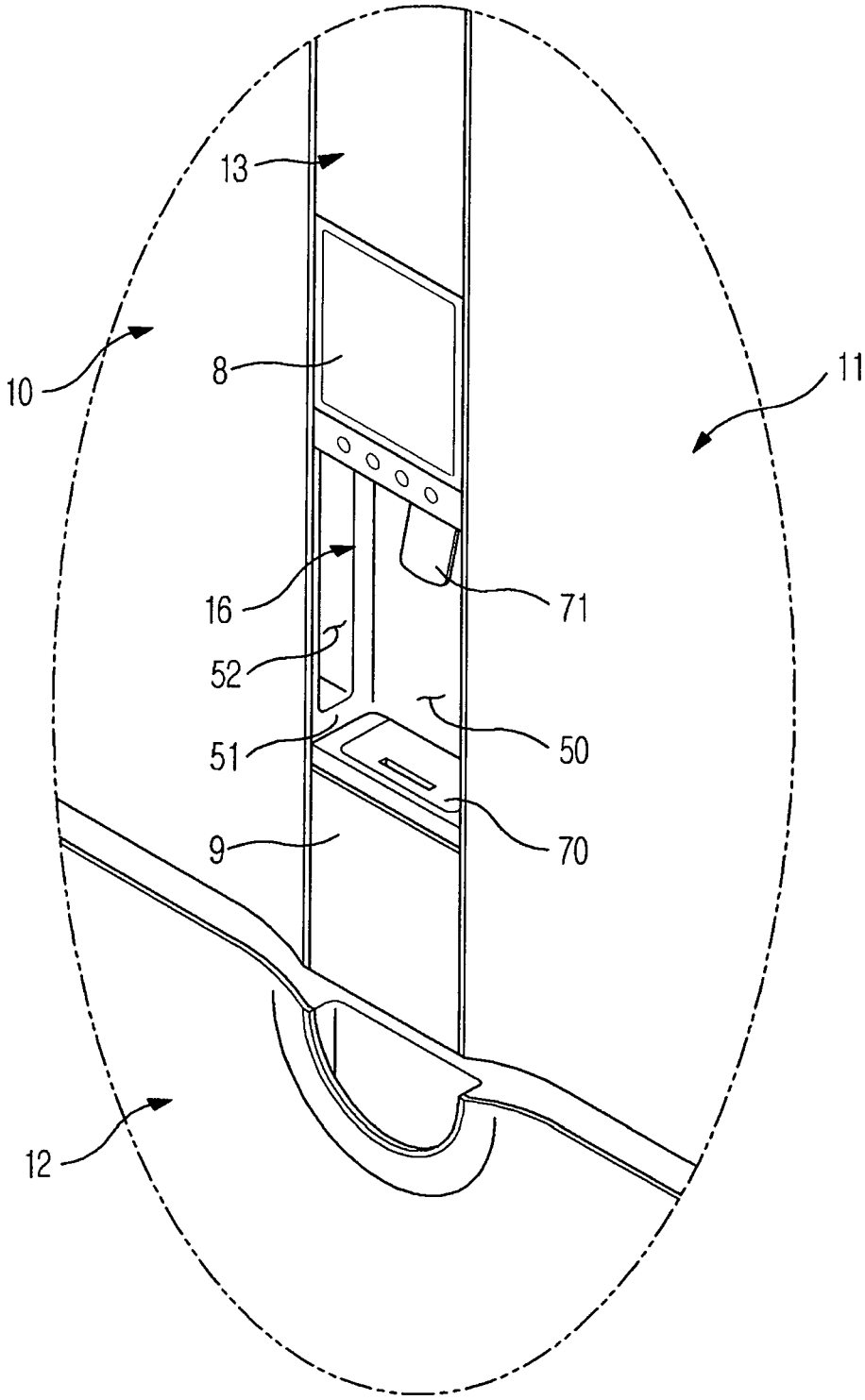
FIG. 3 is a partial perspective view illustrating a front surface of the refrigerator according to the embodiment.
Figure 4:
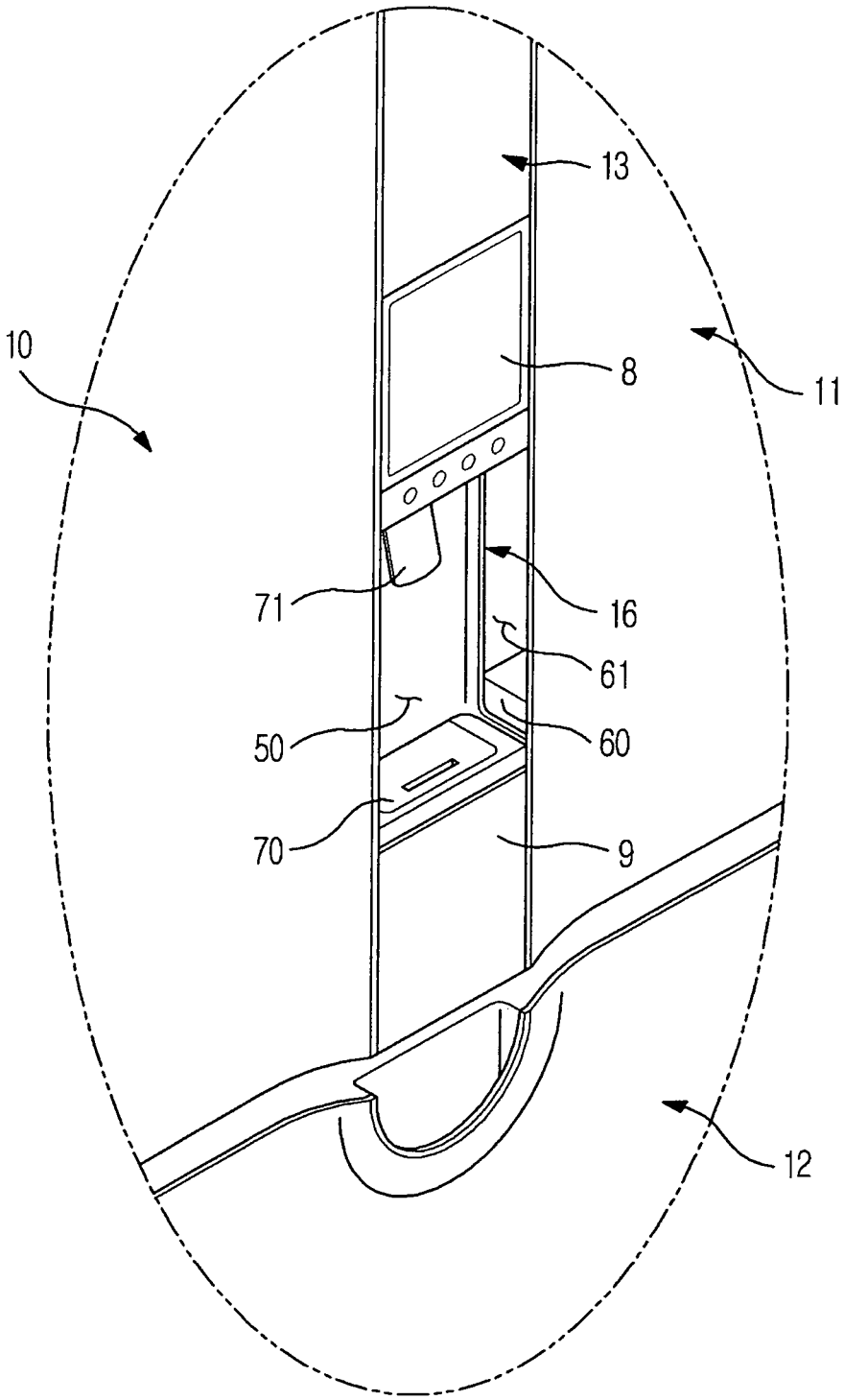
FIG. 4 is a partial perspective view of the front surface of the refrigerator according to the embodiment when viewed in a different angle from FIG. 3.

FIG. 3 is a partial perspective view illustrating a front surface of the refrigerator according to the embodiment, and FIG. 4 is a partial perspective view of the front surface of the refrigerator according to the embodiment when viewed in a different angle from FIG. 3.

The dispenser 16 includes a dispensing space 50 recessed in a front surface of the left door 10, an operating lever 71 adapted to be pushed by the user upon dispensing water from the dispenser 16, a water tray 70 provided on the bottom of the dispensing space 50 to support a container used to receive the water from the dispenser 16, and an outlet 80 through which the water is dispensed.

Figure 5:
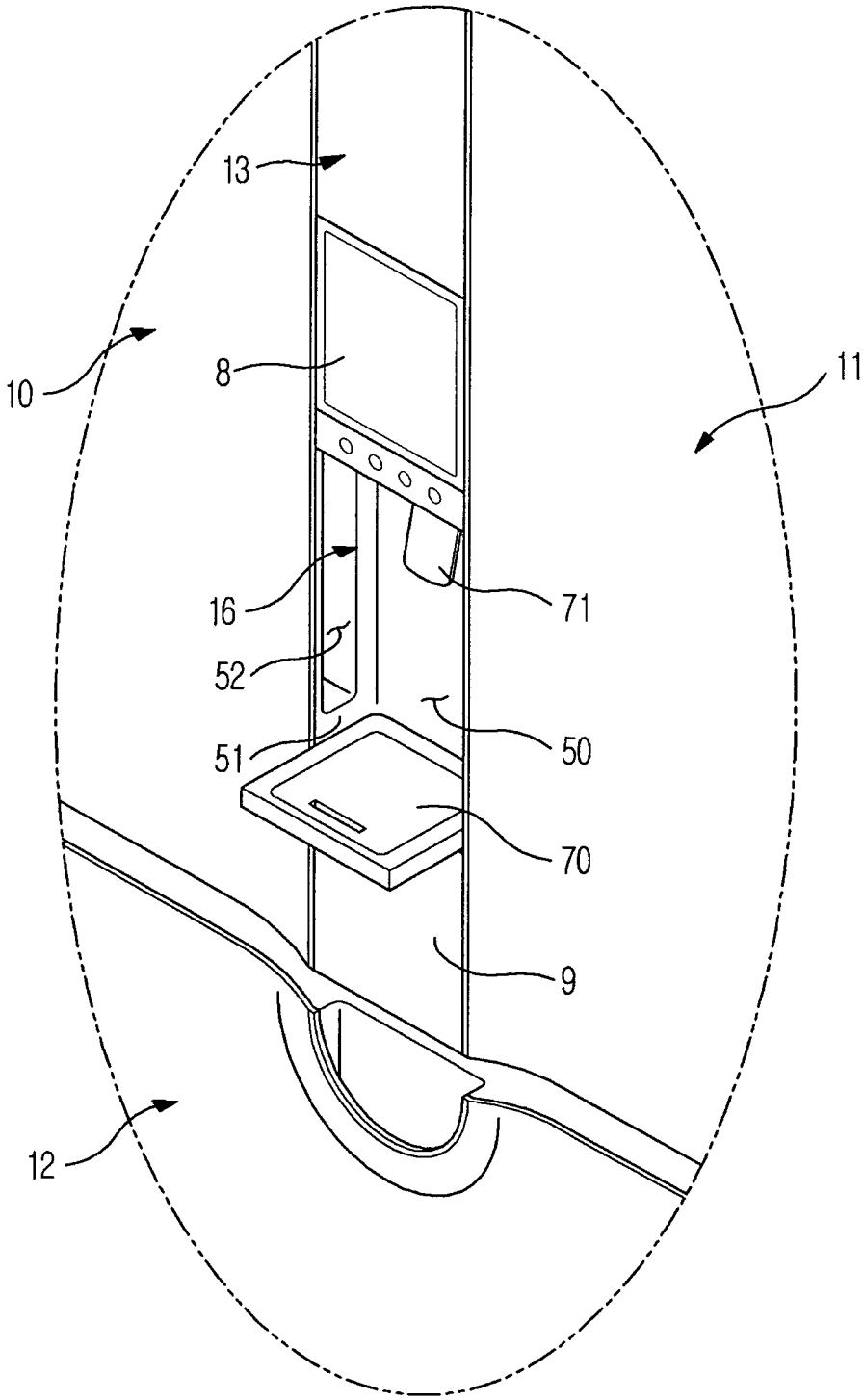
FIG. 5 is a perspective view illustrating a state in which a water tray of the refrigerator according to the embodiment slides out of a dispensing space.

To increase the storage volume of the refrigerating compartment 31 by minimizing the depth of the dispensing space 50, the water tray 70 may be configured to slide out of the dispensing space 50 to have an increased container supporting area when the user uses the dispenser 16 (see FIG. 5).

The dispensing space 50 is provided at a left wall surface 51 thereof with a left door grip portion 52. The left door grip portion 52 is recessed in the left wall surface 61 to have a predetermined depth so as to allow the user to open or close the left door 10 by gripping the left door grip portion 52.

Specifically, the left door 10 may be opened or closed as the user inserts their hand into the left door grip portion 52 recessed in the left wall surface 51 of the dispensing space 50 and grips the left door grip portion 52 and the front surface of the left door 10 to pivot the left door 10.

Accordingly, the left door 10 does not require a handle that protrudes from the front surface of the door to assist the user in opening or closing the door.

Similarly, a right wall surface of the dispensing space 50 is provided with a right door grip portion 61 for opening/closing of the right door 11.

The right door grip portion 61 is recessed in a left surface 60 of the right door 11. To open or close the right door 11, the user may insert their hand into the right door grip portion 61 and grip the right door grip portion 61 and the front surface of the right door 11 to pivot the right door 11.

With the above-described configuration, similar to the left door 10, the right door 11 may also be opened or closed using the right door grip portion 61 without a handle protruding from a front surface of the right door 11.

Figure 7:
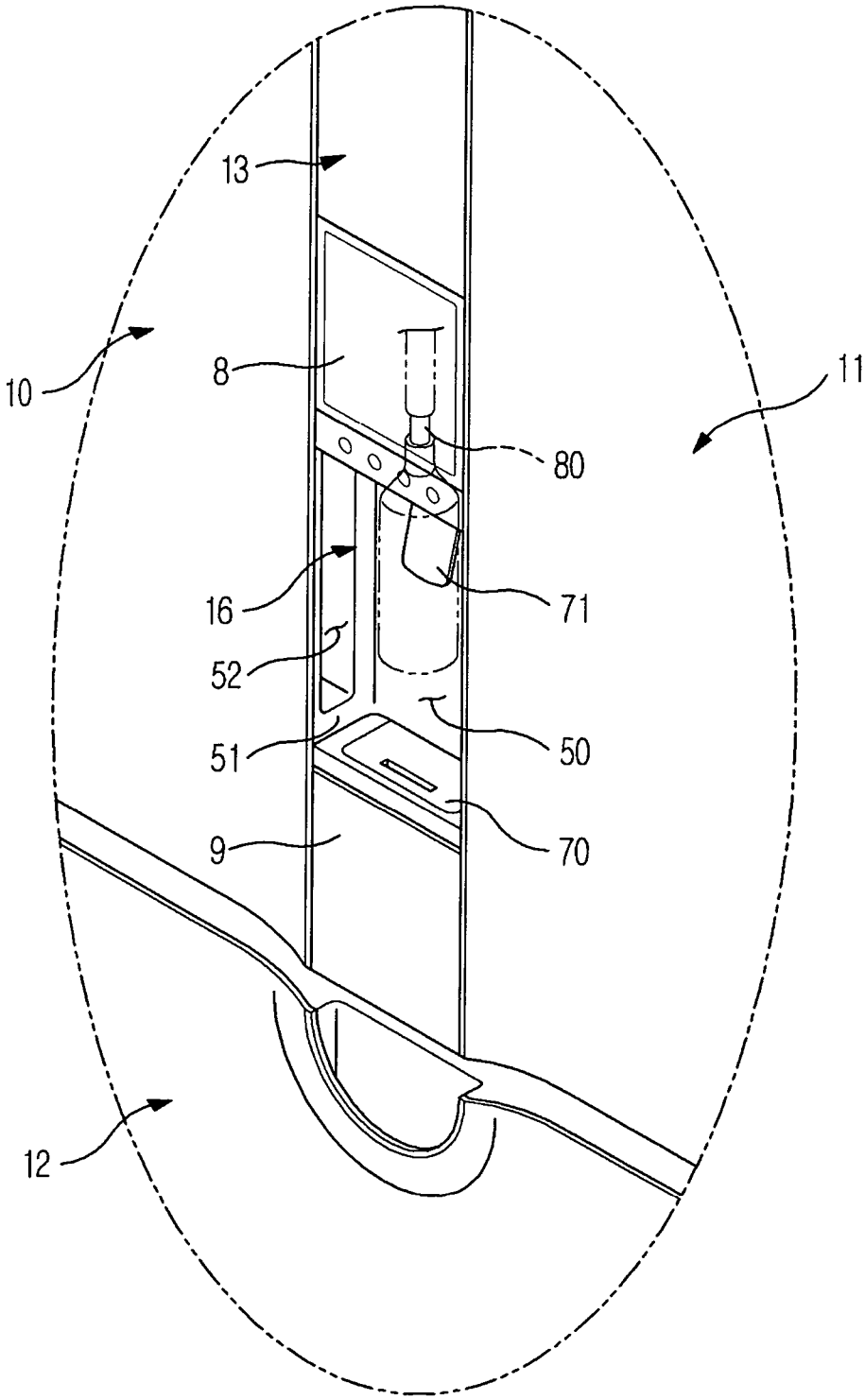
FIG. 7 is a perspective view illustrating a state in which a bottle-shaped container is fitted into an outlet of a dispenser of the refrigerator according to the embodiment.

The outlet 80 of the dispenser 16 is configured such that a bottle-shaped container is secured to the outlet 80 (see FIG. 7).

Since the outlet 80 of the dispenser 16 generally has a tubular shape, positioning a bottle-shaped container having a narrow entrance to receive water from the outlet 80 is difficult, particularly when compared to a cup-shaped container having a wide entrance.

Therefore, the outlet 80 of the dispenser 16 may be configured so as to be fitted into the entrance of the bottle-shaped container to keep the container stationary while water is discharged into the container.

Although the above-described configuration may be realized in various manners, in an exemplary embodiment, the outlet 80 of the dispenser 16 may be slightly smaller than the entrance of the bottle-shaped container having a standard size, and an elastically deformable rubber member may be added to an outer periphery of the outlet 80 to assure stable fitting between the outlet 80 and the entrance of the bottle-shaped container while allowing the user to easily separate the container from the outlet 80.

Of course, the outlet 80 may have various sizes corresponding to various entrance sizes of bottle-shaped containers, or may be variable in size.

Figure 8:
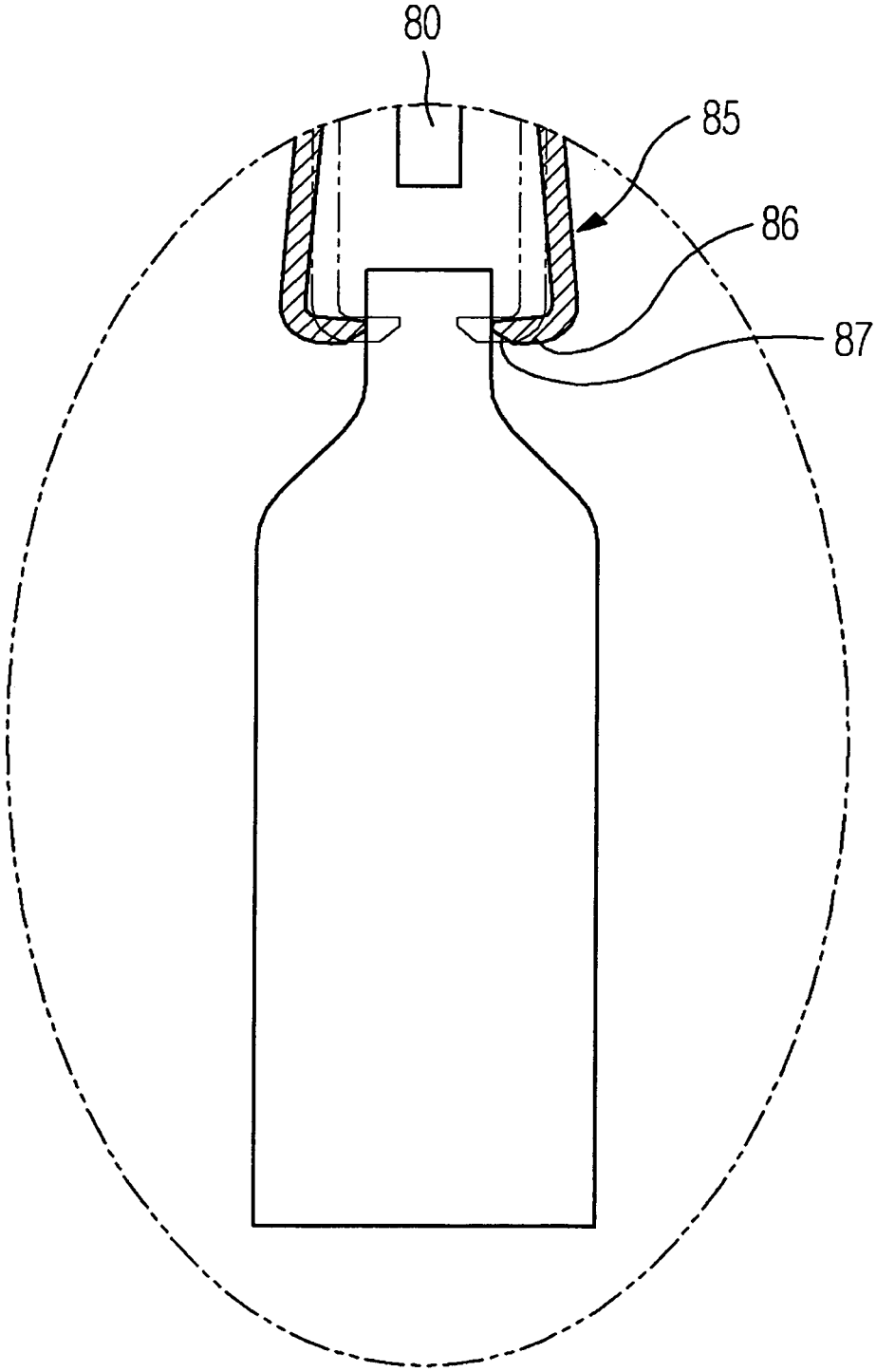
FIG. 8 is a sectional view illustrating one embodiment of a bottle-shaped container securing device usable with the refrigerator.
Figure 9:
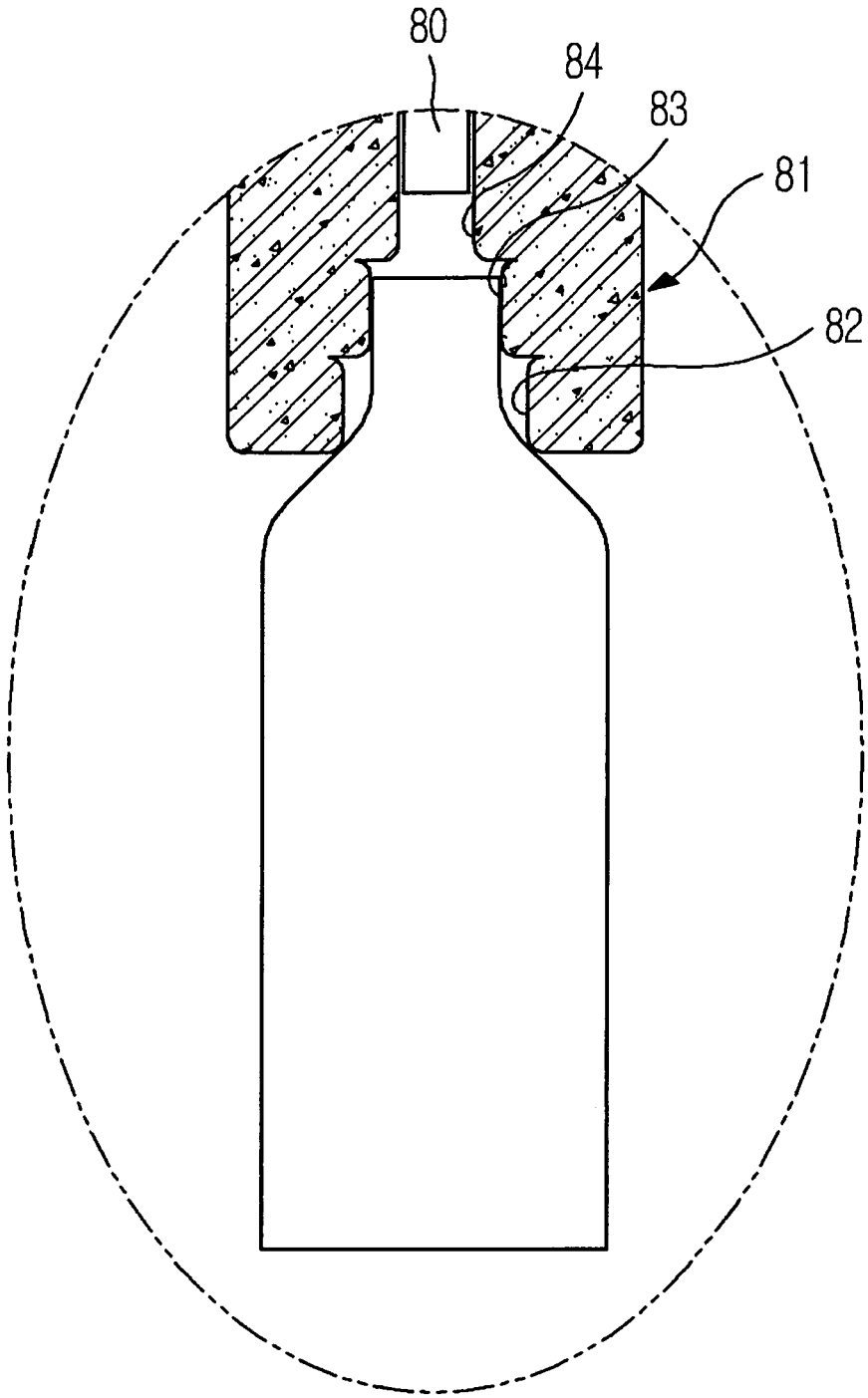
FIG. 9 is a sectional view illustrating another embodiment of a bottle-shaped container securing device usable with the refrigerator.

FIGS. 8 and 9 are sectional views illustrating a bottle-shaped container securing device of the refrigerator according to different embodiments of the present invention.

Referring to FIGS. 8 and 9, the refrigerator according to the embodiment may include a securing device 81 or 85 to secure the bottle-shaped container, thereby allowing water discharged from the outlet 80 of the dispenser 16 to be introduced into the entrance of the bottle-shaped container.

The securing device 81 may be made of elastically deformable rubber and may have coaxial bores 82, 83 and 84 about the outlet 80 of the dispenser 16 for fitting of the bottle-shaped container.

The three bores 82, 83 and 84 have different diameters such that the diameter of a lowermost bore 82 is greater than that of an intermediate bore 83 and the diameter of the intermediate bore 83 is greater than that of an uppermost bore 84. With this configuration, a bottle-shaped container having a relatively large diameter may be fitted into the lowermost bore 82 and a bottle-shaped container having a relatively small diameter may be fitted into the uppermost bore 84.

The securing device 85 may take the form of a leaf spring made of, e.g., stainless steel plates.

The securing device 85 has a cylindrical form having approximately the same diameter as the entrance of the bottle-shaped container and is provided with a plurality of slits extending upward from a lower end thereof to achieve sufficient elasticity.

The lower end of the securing device 85 is provided with an inwardly bent securing portion 86. The securing portion 86 comes into contact with the bottle-shaped container so as to firmly secure the bottle-shaped container. An end 87 of the securing portion 86 is inclined to assure convenient insertion of the bottle-shaped container.

Assuming that the outlet 80 to which a bottle-shaped container may be secured is provided as described above, to enable automated supply of water into the bottle-shaped container, the refrigerator main body may contain a first sensor unit (not shown) to sense whether the bottle-shaped container is secured to the outlet 80 or the securing device 85, a second sensor unit (not shown) to sense the quantity of water stored in the bottle-shaped container, and a control unit (not shown) to dispense water from the outlet 80 when the bottle-shaped container is secured to the outlet 80 and to stop dispensing water from the outlet 80 when the quantity of water stored in the bottle-shaped container reaches a preset quantity.

The first sensor unit (not shown) and the second sensor unit (not shown) may include various sensors. For example, a pressure sensor (not shown) may be provided at the outlet 80 or the securing device 85 to sense whether a predetermined pressure is applied to the outlet 80 or the securing device 85, thereby determining whether the bottle-shaped container is secured to the outlet 80 or the securing device 85. In addition, an infrared sensor (not shown) may be mounted above the entrance of the bottle-shaped container to sense the quantity of water stored in the bottle-shaped container based upon reflection of infrared light by the water. Alternatively, a weight sensor (not shown) may be coupled to the outlet 80 or the securing device 85 to sense the quantity of water stored in the bottle-shaped container by measuring the weight of the bottle-shaped container.

As is apparent from the above description, a refrigerator according to the embodiment is configured such that a right door of a pair of pivoting opening/closing doors that a user more frequently opens has a width less than that of a left door. This may minimize leakage of cold air caused upon opening/closing of the door and enhance usability of the refrigerator.

Further, providing a dispenser and a display unit at the center of a front surface of the refrigerator may allow the user to more easily use the refrigerator.

Furthermore, as a door grip is hidden, the refrigerator may have a tidy outward appearance.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body;

a single storage compartment defined in the main body;

left and right doors hinged to opposite lateral sides of the main body to open or close the single storage compartment; and a dispenser comprising a dispensing space recessed in a front surface of the left door and located at the center of opposite lateral surfaces of the main body, wherein the left door has a width greater than that of the right door, and wherein the dispensing space includes a left door grip portion recessed in a left wall surface of the dispensing space to enable opening or closing of the left door.

2. The refrigerator according to claim 1, wherein the right door includes a right door grip portion recessed in a left surface of the right door to enable opening or closing of the right door through the dispensing space.

3. The refrigerator according to claim 1, wherein:

the left door further includes a display unit serving to display operating modes of the refrigerator or having an input unit; and the display unit is located above the dispenser at the center of opposite lateral surfaces of the main body.

4. The refrigerator according to claim 1, wherein:

the left door further includes a drawer type storage container mounted in a slidable manner; and the drawer type storage container is located below the dispenser at the center of opposite lateral surfaces of the main body.

5. The refrigerator according to claim 1, wherein:

the dispensing space to have a predetermined depth and a water tray provided on the bottom of the dispensing space; and the water tray is adapted to slide out of the dispensing space.

6. The refrigerator according to claim 1, wherein:

the dispenser includes an outlet to dispense water to the outside; and the outlet is configured to be inserted into an entrance of a bottle-shaped container having a standard size to allow the container to be secured to the outlet.

7. The refrigerator according to claim 1, further comprising a securing device to secure a bottle-shaped container having a standard size, thereby allowing water discharged from the dispenser to be introduced into an entrance of the bottle-shaped container.

8. The refrigerator according to claim 6, further comprising a control unit to dispense water from the outlet when the bottle-shaped container is secured to the outlet and stop dispensing the water when the quantity of water stored in the bottle-shaped container reaches a preset quantity.

9. The refrigerator according to claim 7, further comprising a control unit to dispense water from the outlet when the bottle-shaped container is secured to the outlet and stop dispensing the water when the quantity of water stored in the bottle-shaped container reaches a preset quantity.

10. The refrigerator according to claim 7, wherein the securing device comprises a form of a leaf spring made of stainless steel plates.

11. The refrigerator according to claim 7, wherein a lower end of the securing device includes an inwardly bent securing portion which comes into contact with the bottle-shaped container so as to secure the bottle-shaped container.

12. The refrigerator according to claim 5, wherein the bottom of the dispensing space having a supporting area for a container that is increased when the water tray is slid out.

13. The refrigerator according to claim 7, wherein the securing device comprises a plurality of coaxial bores.

14. The refrigerator according to claim 1, further comprising a sensor for detecting a container within the dispensing space.

15. A refrigerator comprising a main body, a single storage compartment defined in the main body and left and right doors hinged to opposite lateral sides of the main body so as to open or close the single storage compartment, wherein the left door includes a center section located at the center of opposite lateral surfaces of the main body, wherein the center section includes a dispenser having a dispensing space recessed in a front surface of the left door and a display unit serving to display operating modes of the refrigerator or having an input unit, and wherein the dispensing space is provided at opposite lateral sides thereof with left and right door grip portions to allow the left and right doors to be gripped for opening or closing of the doors.

16. The refrigerator according to claim 15, wherein the center section further includes a drawer type storage container.

17. The refrigerator according to claim 15, wherein the drawer type storage container is mounted to the left door in a slidable manner.

18. The refrigerator according to claim 15, wherein:

the dispenser includes a water tray to support a container; and the water tray is adapted to slide out of the dispensing space.

* * * * *